US006739933B2

(12) United States Patent
Taylor

(10) Patent No.: US 6,739,933 B2
(45) Date of Patent: May 25, 2004

(54) WEARABLE DRINK HOLDER

(76) Inventor: Elaine Taylor, 7730 Erinwood Ct., East, Jacksonville, FL (US) 32258

( * ) Notice: Subject to any disclaimer, the term of this patent is extended or adjusted under 35 U.S.C. 154(b) by 0 days.

(21) Appl. No.: 10/396,631

(22) Filed: Mar. 25, 2003

(65) Prior Publication Data

US 2003/0186614 A1 Oct. 2, 2003

Related U.S. Application Data

(60) Provisional application No. 60/367,571, filed on Mar. 26, 2002.

(51) Int. Cl.[7] ..... A63H 33/00

(52) U.S. Cl. ..... 446/28; 220/709; 220/703; 446/73; 446/304

(58) Field of Search ..... 446/26–28, 71–74, 446/76, 227, 267, 475, 901, 491, 304; 2/49.1, 49.2; 224/148.1–148.7; 472/52; 206/457; 215/10, 12.1, 388, 389; 40/538, 586; 220/709, 703; 248/908

(56) References Cited

U.S. PATENT DOCUMENTS

| | | | | | |
|---|---|---|---|---|---|
| D141,700 | S | | 6/1945 | Raport | |
| D145,611 | S | | 9/1946 | Butterfield | |
| 2,555,107 | A | * | 5/1951 | Beebe | 446/305 |
| D165,235 | S | | 11/1951 | Miller | |
| 2,711,052 | A | | 6/1955 | Brayford | |
| 4,277,910 | A | | 7/1981 | Kramer | |
| 4,280,292 | A | * | 7/1981 | Hills | 40/538 |
| D287,636 | S | | 1/1987 | Callju | |
| 4,662,550 | A | * | 5/1987 | O'Donnell | 224/657 |
| 4,815,999 | A | * | 3/1989 | Ayon et al. | 446/73 |
| D305,346 | S | | 1/1990 | Roberts | |
| D314,432 | S | | 2/1991 | Shaw | |
| 5,072,843 | A | | 12/1991 | James | |
| D325,460 | S | | 4/1992 | Cameron | |
| 5,217,192 | A | | 6/1993 | Oktayuren | |
| 5,312,282 | A | * | 5/1994 | Cooper | 446/27 |
| 5,326,300 | A | | 7/1994 | Sonders | |
| D352,595 | S | | 11/1994 | Cameron | |
| 5,540,611 | A | | 7/1996 | Lapoint et al. | |
| 5,624,090 | A | | 4/1997 | Gammelgaard | |
| 5,749,764 | A | | 5/1998 | Bailey | |
| D402,761 | S | | 12/1998 | Jones | |
| 5,871,184 | A | | 2/1999 | Kaopio | |
| 5,979,843 | A | | 11/1999 | Beck | |
| 6,055,667 | A | | 5/2000 | Jimenez | |

FOREIGN PATENT DOCUMENTS

| | | | | |
|---|---|---|---|---|
| GB | 2254999 A | * | 10/1992 | A47G/19/22 |
| GB | 2275179 | * | 8/1994 | A47G/19/22 |

* cited by examiner

*Primary Examiner*—Jacob K. Ackun
*Assistant Examiner*—Bena B. Miller
(74) *Attorney, Agent, or Firm*—Thomas C. Saitta

(57) ABSTRACT

A wearable drink holder apparatus. In accordance with one embodiment, the wearable drink holder apparatus includes an animal-shaped body member having an interior compartment for securely encasing a drink container therewithin. Elongated support straps shaped as grasping animal limbs are utilized to attach the animal-shaped body member to a wearer's body. A protuberance member formed in the shaped of an animal face extends from the top of and approximately centrally aligned with the body member. The protuberance member includes an interior cavity through which a drinking conduit extends from the drink container to the exterior of the protuberance member toward the wearer's face.

16 Claims, 3 Drawing Sheets

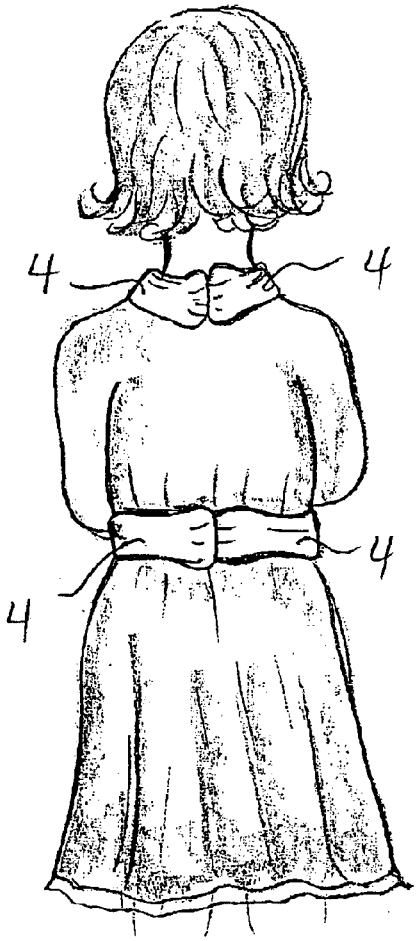
FIG. 3
FIG. 4
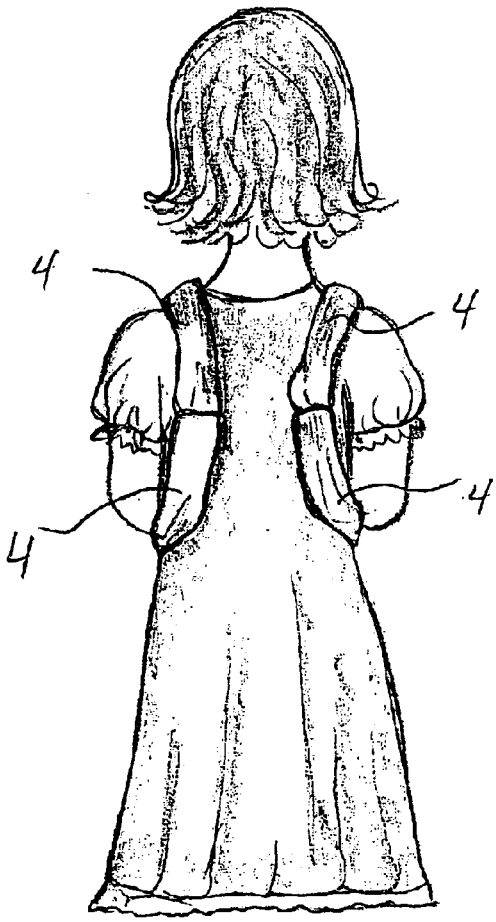

WEARABLE DRINK HOLDER

This application claims the benefit of U.S. Provisional Application Serial No. 60/367,571, filed on Mar. 26, 2002.

BACKGROUND OF THE INVENTION

1. Technical Field

The present invention relates generally to the field of drink containers and in particular to drink containers having clasping, grabbing, or holding features that enable the drink container to be accessed, such as by young children or infants, in a no-hands manner.

2. Description of the Related Art

Prior art has demonstrated devices for holding a nippled baby bottle and also decorative devices for wrapping around a baby bottle. Prior art patents show baby bottle holders having straps that fasten around the neck of the baby in order to aid in feeding the baby. Other related patents disclose baby carrying bags in the shape of stuffed animals and activity bags for children in the shape of stuffed animals.

Such prior art bottle support devices are disclosed and depicted in U.S. Pat. No. 5,979,843 issued to Beck, U.S. Design Pat. No. Des. 325,460, issued to Cameron, and U.S. Pat. No. 6,055,667, issued to Jimenez. Cameron, for example, illustrates a combined bib and bottle support apparatus in which a drink container holder loop is attached to the center of a body portion for supporting a typical baby bottle. A pair of hooked loop members extend from the top sides of the body portion presumably for attaching around the neck or shoulders of a child thus enabling the bottle to remain fastened to the child's body with the body portion serving as a bib between the child's torso and the bottle. While effective for maintaining a bottle attached to the front of the child's body and preventing spillage or seepage on the bottle from reaching the child's clothes or body, Cameron's bib and bottle support apparatus results in the baby bottle nipple pointing straight up thus restricting or precluding oral access to the nipple by the child wearer.

Like Cameron, Beck and Jimenez depicted bottle support devices that include straps or loops for securely fastening a bottle-retaining container in close proximity to a child's frontal torso. In addition, however, the Beck and Jimenez baby bottle holders incorporate bottle tilting features in the form of a wedge like member that tilts the bottle at an angle suitable for the child to have oral access to the bottle nipple without having to undue crane his/her neck. Utilization of such bottle-tilting wedges, however, is unwieldy and likely uncomfortable for young children as they feed or drink.

It can therefore be appreciated that a need exists for an improved wearable drink holder apparatus that addresses the foregoing problems with prior art baby bottle holders. The present invention addresses such a need.

SUMMARY OF THE INVENTION

The invention comprises in general a carrying device, shaped as an animal or character having a face, for holding a drinking container from which a drinking straw extends. The straw extends from the container retained within the body of the carrying device and exits through the mouth of the carrying device. Elongated strap members are located on the exterior of the carrying device so that the device can be fastened around the child's neck, and preferably the strap members are formed as the arms, legs or ears of the animal or character. The child is able to drink from the straw while the carrying device hangs on the child's chest, creating the effect of kissing the animal or character.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 3 depicts a wearable drink holder apparatus wherein two sets of strap members may be provided, such that the "arms" can be joined about the neck of the child while the "legs" may be joined about the torso of the wearer; and FIG. 4 illustrates a wearable drink holder apparatus including vertically oriented support straps in accordance with an alternate embodiment of the present invention.

DETAILED DESCRIPTION OF A PREFERRED EMBODIMENT

The present invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the invention.

As explained in further detail with reference to the figures, the present invention is directed to a wearable drink holder apparatus particularly applicable to enabling an infant or young child to conveniently and enjoyably sip or suckle from a drink container as it is worn on the child's body. Specifically, the present invention is directed to deploying a drink container within an interior compartment of a plush or stuffed toy in the shape of an animal or character having a face, where a suitably directed drinking conduit, such as a flexible straw, is utilized to draw liquid from the container, and where the drinking conduit protrudes from the mouth of the toy to create the effect of kissing the animal or character during use.

Figure 1:
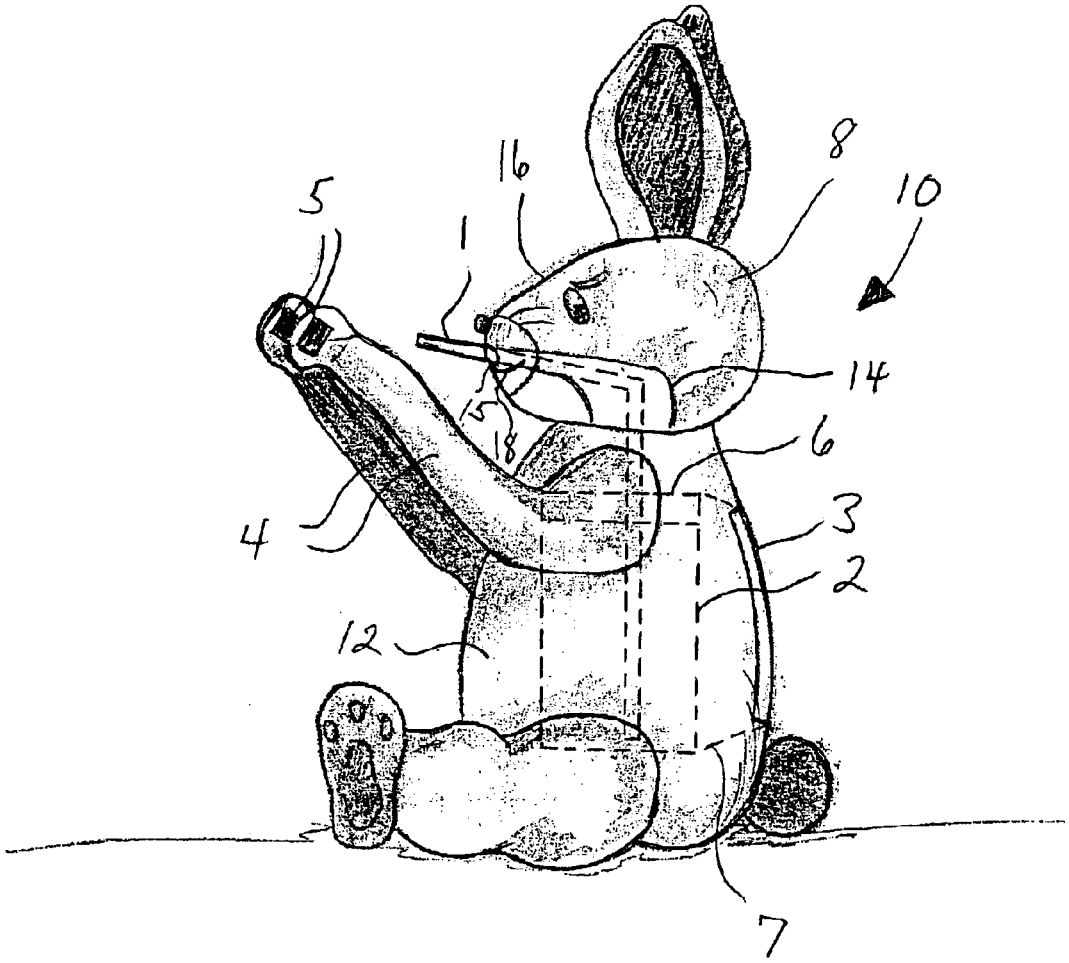
FIG. 1 is a side view depicting a wearable drink holder apparatus in accordance with a preferred embodiment of the present invention.

With reference now to the figures, wherein like reference numerals refer to like and corresponding parts throughout, and in particular with reference to FIG. 1, there is depicted a wearable drink holder 10 in accordance with a preferred embodiment of the present invention. Specifically, wearable drink holder 10 includes a body member 12 preferably made of a soft outer layer material such as plush or other soft material which is stuffed, but which may alternatively be made of soft or even hard plastic or similar material. Although represented as a rabbit-like doll in the depicted embodiment, wearable drink holder 10 may be in the shape of any character, animal, sports figure or mascot, or any other similar creature. Body member 12 further includes an interior compartment 7 within which a drink container 2 is securely encased. Wearable drink holder 10 may be of any size, so long as a drink container 2 may fit inside the interior compartment 7, which may include an inner lining of an insulating material (not depicted) to insulate the liquid stored within drink container 2.

Drink container 2 may be any type of conventional drinking vessel, such as a bottle made of plastic and having one closed end and one opened end, with the open end sealable by a replaceable cover 6, or may comprise a flexible pouch or bladder. Either replaceable cover 6 or drink container 2 itself includes an aperture through which a drinking conduit 1 is inserted into the liquid drink contained within drink container 2, which may be of any shape or size so long as it fits within interior compartment 7. Wearable drink holder 10 and the drink container 2 contained within are both preferably washable.

In accordance with a preferred embodiment, the "head" of the animal-shaped wearable drink holder 10 comprises, in principle of invention, a protuberance member 8 extending from the top of and approximately centrally aligned with body member 12. By "centrally aligned" it is meant that protuberance member 8 is positioned between the lateral side edges (with wearable drink holder 10 frontally viewed) and is generally aligned with the central vertical axis (not depicted) of body member 12. Protuberance member 8 is preferably configured such that a recognizable front face 16 is presented, and furthermore includes an interior cavity 14 through which a drinking conduit 1 extends from the interior of drink container 2 to the exterior of protuberance member 8 through a frontally disposed aperture 15. Drinking conduit 1 is preferably a flexible straw or other flexible and/or hinged narrow conduit member suitable for being directed from drink container 2, through interior cavity 14 and passing substantially toward the child wearer's face such that the child can readily sip from the conduit without having to twist, turn or tilt any part of wearable drink holder 10.

As shown in FIG. 1, aperture 15 is disposed on front face 16 of protuberance member 8 in a manner such that drinking conduit 1 is guided toward the wearer's face. Furthermore, front face 16 is preferably shapedly formed to simulate an animal or human face with aperture 15 being disposed on or near the mouth 18 of the animal or human shaped front face 16 such that when the child wearer sips from drinking conduit 1, the animal or human shaped front face 16 appears to kiss the child wearer.

As further illustrated in FIG. 1, access to interior compartment 7 is enabled by a long access slit 3 in the back, front, sides or bottom of body member 12, providing a means for inserting or removing drink container 2. Although not expressly represented in the depicted embodiment, access slit 3 preferably comprises zipper or hook-and-loop fastener means for securing access in and out of interior compartment 7. Alternatively, wearable drink holder 10 may be constructed such that the "head" portion (i.e. protuberance member 8) is removable from body member 12 to provide access to interior compartment 7.

Wearable drink holder 10 further includes support means in the form of at least one strap member that is at least partially looped around the child wearer's neck for attaching wearable drink holder 10 in general, and body member 12 in particular, to the child wearer's body. In the depicted embodiment, the support means comprise a pair of elongated strap members 4 that are shapedly formed to simulate a pair of animal or human limbs with the "shoulders" fixedly attached to the exterior sides of body member 12. Alternative arrangements are available by using strap members 4 that resemble other appendages such as ears, legs, a tail, or even straps similar to those of a backpack. For example, the ears of a rabbit or a donkey may also provide a similar arrangement and construction for use as strap members 4. As illustrated in FIG. 3, two sets of strap members 4 may be provided, such that the "arms" can be joined about the neck of the child while the "legs" may be joined about the torso of the child. In an alternate embodiment shown in FIG. 4, the left "arm" and "leg" can be joined, and the right "arm" and "leg" joined to form vertically oriented straps similar to those of a backpack.

Strap members 4 preferably extend to an appropriate length for fastening around the child's neck such that the device will rest on the chest or stomach of the child, and are preferably separable. Although not expressly depicted in FIG. 1, one skilled in the art will understand and appreciate the modifications necessary to deploy length adjustment means for adjusting the length of one or both of strap members 4 such that the relative distance between protuberance member 8 and the child wearer'surface can be optimally set. In addition to providing a means of securing wearable drink holder 10 to a child wearer's neck or shoulders, strap members 4 also enable the wearable drink holder 10 to be secured to inanimate items, such as a stroller or a chair.

Figure 2:
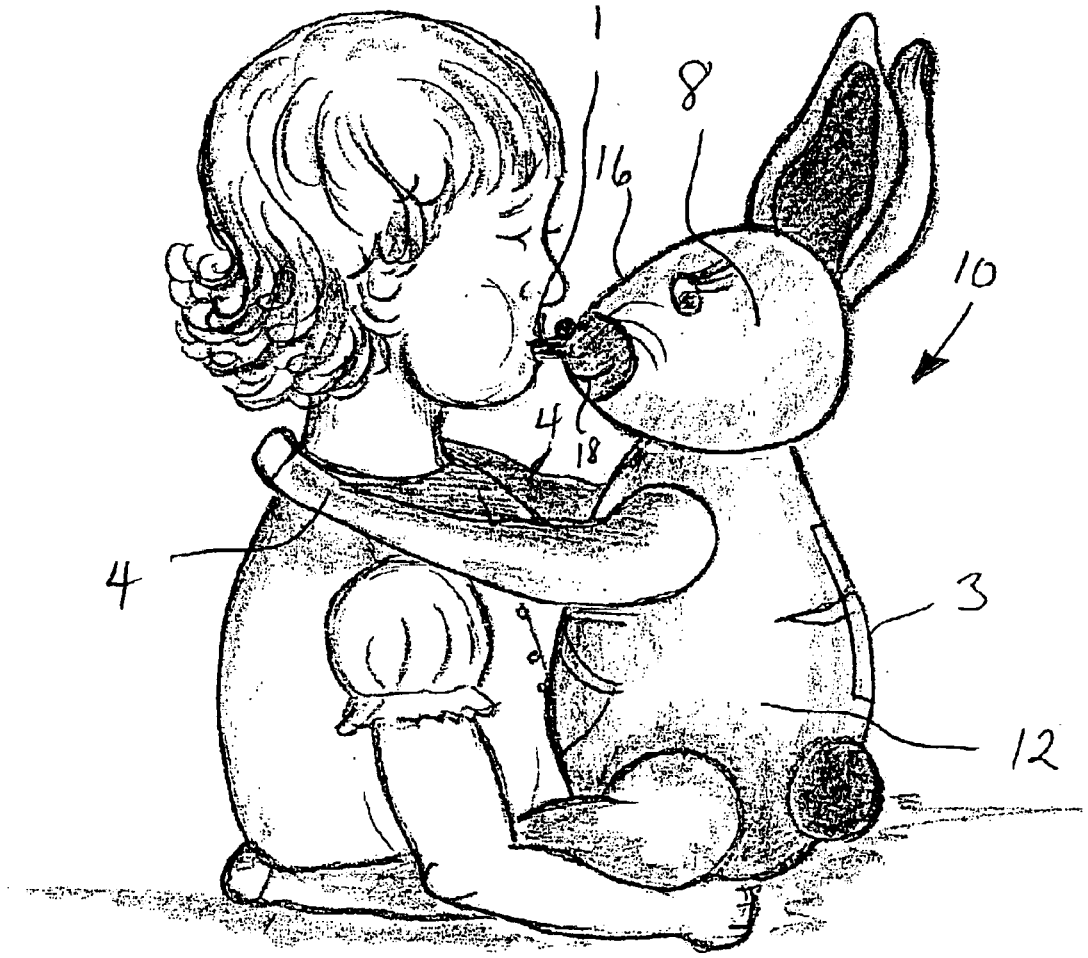
FIG. 2 is a perspective view illustrating the wearable drink holder apparatus in use with a child.

Located on the end of each strap member 4 is preferably a fastener element 5 for securing wearable drink holder 10 around the child's neck. Fastener elements 5 are made of suitable fastening means, such as hook-and-loop fasteners, snaps, buckles, clamps or other similar means, and are attached to the end of one or both of strap members 4 such that strap members 4 mutually couple and can therefore be securely looped about the child's neck and/or shoulder area. As illustrated in FIG. 2, the deployment of drink container 2 within wearable drink holder 10 in the depicted configuration, results in wearable drink holder 10 and drink container 2 being retained in an upright position on the child's chest such that the child does not need to hold the bottle or animal when walking, standing or during other activities.

After fastening wearable drink holder 10 around the child's neck, the child may then sip the liquid through the straw 1 and at the same time create the effect of kissing the animal. When not in use, wearable drink holder 10 may be placed down on a table or the like, with wearable drink holder 10 preferably including an internal support structure (not depicted) or being composed of sufficiently rigid material to permits wearable drink holder 10 to sit on its own with drinking container 2 in an upright position.

While this invention has been described in terms of several embodiments, it is contemplated that alterations, permutations, and equivalents thereof will become apparent to one of ordinary skill in the art upon reading this specification in view of the drawings supplied herewith. It is therefore intended that the invention and any claims related thereto include all such alterations, permutations, and equivalents that are encompassed by the spirit and scope of this invention.

What is claimed is:

1. A wearable drink holder apparatus comprising:

a removable drink container comprising a drinking conduit for suctioning liquid from said drink container;

a body member composed of a soft outer layer material and having an interior compartment for securely encasing said drink container therewithin, wherein said body member is shapedly formed to simulate an animal or human body;

support means for attaching said body member to a wearer's body; and a protuberance member extending from the top of said body member, wherein said protuberance member comprises a front face including a frontally mounted aperture for guiding said drinking conduit toward the wearer's face, said protuberance member including an interior cavity through which said drinking conduit extends from the said drink container to the exterior of said protuberance member and wherein said front face is shapedly formed to simulate an animal or human face.

2. The wearable drink holder apparatus of claim 1, wherein said body member includes interior compartment access means, said interior compartment access means enabling removal and replacement of said drink container.

3. The wearable drink holder apparatus of claim 2, wherein said interior compartment access means comprises zipper means.

4. The wearable drink holder apparatus of claim 2, wherein said interior compartment access means comprises hook and loop fastener means.

5. The wearable drink holder apparatus of claim 1, wherein said protuberance member is removably attachable to a top side of said body member.

6. The wearable drink holder apparatus of claim 1, wherein said protuberance member is approximately centrally aligned with said body member.

7. The wearable drink holder apparatus of claim 1, wherein said frontally mounted aperture is disposed on or near a mouth of the animal or human shaped front face such that when the wearer drinks from the drinking conduit the animal or human shaped face appears to kiss the wearer.

8. The wearable drink holder apparatus of claim 1, wherein said support means comprises at least one strap member.

9. The wearable drink holder apparatus of claim 8, wherein said at least one strap member comprises a pair of vertically oriented straps looped around the wearer's shoulders in a backpack-like manner.

10. The wearable drink holder apparatus of claim 8, wherein said at least one strap member is designed to be looped at least partially around the wearer's neck.

11. The wearable drink holder apparatus of claim 8, wherein said at least one strap member includes length adjustment means for adjusting the length of said at least one strap member such that the relative distance between said protuberance member and the wearer's face can be optimally set.

12. The wearable drink holder apparatus of claim 1, wherein said support means comprises a pair of straps fixedly attached to the sides of the body member.

13. The wearable drink holder apparatus of claim 12, wherein said pair of straps is shapedly formed to simulate a pair of animal or human limbs.

14. The wearable drink holder apparatus of claim 12, wherein said pair of straps include fastening means for securing said wearable drink holder apparatus around the wearer's neck.

15. The wearable drink holder apparatus of claim 14, wherein said fastening means is chosen from the group of fastening means consisting of tie ends, buckles, hook-and-loop fasteners, snaps, and clamps.

16. An improved wearable drink holder apparatus comprising:

a removable drink container comprising a drinking conduit for suctioning liquid from said drink container;

a body member having an interior compartment for securely encasing said drink container therewithin, wherein said body member is shapedly formed to simulate an animal or human body, said body member including interior compartment access means, said interior compartment access means enabling removal and replacement of said drink container;

a pair of straps fixedly attached to the sides of the body member for attaching said body member to a wearer's body, said pair of straps shapedly formed to simulate a pair of animal or human limbs; and a protuberance member extending from the top of said body member and including an interior cavity through which a drinking conduit extends from the drink container to the exterior of said protuberance member, said protuberance member including a front face that is shapedly formed to simulate an animal or human face and including a frontally mounted aperture for guiding said drinking conduit toward the wearer's face, said frontally mounted aperture disposed on or near a mouth of the animal or human shaped front face such that when the wearer drinks from the drinking conduit the animal or human shaped face appears to kiss the wearer.

* * * * *